US010739036B2

(12) United States Patent
Home

(10) Patent No.: US 10,739,036 B2
(45) Date of Patent: Aug. 11, 2020

(54) HEATER STRUCTURE

(71) Applicant: GRAND HALL ENTERPRISE CO., LTD., Taipei (TW)

(72) Inventor: William Home, Taipei (TW)

(73) Assignee: GRAND HALL ENTERPRISE CO., LTD., Taipei (TW)

( * ) Notice: Subject to any disclaimer, the term of this patent is extended or adjusted under 35 U.S.C. 154(b) by 89 days.

(21) Appl. No.: 16/245,263

(22) Filed: Jan. 11, 2019

(65) Prior Publication Data

US 2020/0224928 A1 Jul. 16, 2020

(51) Int. Cl.

| | |
|---|---|
| ***F23D 14/12*** | (2006.01) |
| ***F24H 9/20*** | (2006.01) |
| ***F23N 1/00*** | (2006.01) |
| ***F23D 14/76*** | (2006.01) |
| ***F23K 5/00*** | (2006.01) |

(52) U.S. Cl.

CPC ..... *F24H 9/2085* (2013.01); *F23D 14/76* (2013.01); *F23K 5/007* (2013.01); *F23N 1/007* (2013.01); *F23K 2900/05001* (2013.01); *F23K 2900/05002* (2013.01); *F23N 2235/24* (2020.01); *F23N 2241/02* (2020.01)

(58) Field of Classification Search

CPC ..... F24H 9/2085; F24H 1/186; F24H 9/2035; F24H 9/2064; F24H 9/2071; F24D 19/1069; F24D 19/1081; F24D 19/1084; F24D 2240/26; F24D 12/02; F24D 17/0031; F24D 19/1051; F24D 2200/067; F24D 2200/08; F24D 2200/10; F24D 3/08; F24D 3/10; F24D 3/1083; F24D 5/02; F23D 14/76; F23N 5/242; F23N 5/102; F23N 5/203; F23N 1/005; F23N 1/022; F23N 2227/02; F23N 2229/02; F23N 2227/24; F23N 2227/36; F23N 5/105; F23N 5/24; F23N 1/002; F23N 2005/181; F23N 2223/08; F23N 2223/38; F23N 2225/16; F23N 2227/04; F23N 2227/22; F23N 2231/04; F23N 2231/08; F23N 2231/28; F23N 2233/04; F23N 2241/02; F23N 2241/04; F23N 5/10; F23N 5/123; F23N 5/265; F23N 1/007; F23N 1/082; F23N 1/085; F23N 2223/04; F23N 2225/04; F23N 2225/08; F23N 2225/14; F23N 2225/19; F23N 2227/26; F23N 2227/30; F23N 2229/12; F23N 2231/10; F23N 2231/12; F23N 2231/18; F23N 2231/20; F23N 2231/26; F23N 2235/14; F23N 2237/02; F23N 2237/06; F23N 2237/10; F23N 2237/30; F23N 2239/04; F23N 5/003; F23N 5/022; F23N 5/245

See application file for complete search history.

*Primary Examiner* — Jason Lau

(74) *Attorney, Agent, or Firm* — Leong C. Lei

(57) ABSTRACT

A heater structure includes a heater body including a burner connected to a valve switch. A pilot fire assembly is covered by a protective cover that has ventilation holes. A switch unit includes an ignition switch, a shut-down switch, an ignition operator, and a shut-down operator. The ignition operator and the shut-down operator are structured to provide a swingable arrangement. The ignition operator may be operated to contact and press the fuel gas valve rod and the ignition switch to open the valve switch for supply fuel gas to the burner and to activate an ignition circuit to cause successive shootings of an ignition pin of the pilot fire assembly to set a flame on the burner. The shut-down operator is operated to contact and press the shut-down switch, so as to cut off a signal of the thermocouple and thus cut off the supply of the fuel gas.

9 Claims, 7 Drawing Sheets

HEATER STRUCTURE

(a) TECHNICAL FIELD OF THE INVENTION

The present invention relates generally to a heater structure, and more particularly to a heater structure that allows a user to easily operate a switch for supplying fuel gas, igniting a burner, and cutting off the supply of fuel gas so as to reduce influence of a pilot fire by an outside airflow.

(b) DESCRIPTION OF THE PRIOR ART

Heaters (such as outdoor heating devices) that are commonly available in the market are generally of a structure that uses a burner (such as an infrared ceramic burner) to heat air surrounding the heater in order to achieve the purpose of heating and warming outdoors. The heater may keep generating high temperature through continuous supply of fuel gas for applications of heating and warm-keeping.

A known outdoor heart is located outdoors and the flame of the burner is often blown out by winds or gusts. A user needs to frequently re-ignite the burner by operating an ignition switch. This is inconvenient and troublesome. Therefore, for an outdoor heater, operability of the ignition switch in respect of the functionality and structure thereof and users' convenience of operation are vital.

Further, the known outdoor heater does not provide any protection measure for a pilot fire generated by a pilot fire assembly and thus, the pilot fire may get randomly moved or even blown out. This results in malfunctioning of a thermocouple, and eventually lead to failure of the outdoor heater. Thus, it would be vital to provide the pilot fire assembly with a protection structure.

SUMMARY OF THE INVENTION

An objective of the present invention is to provide a heater structure that allows a user to easily operate a switch for supply fuel gas, igniting a burner, and cutting of the supply of fuel gas and also to reduce influence imposed on a pilot fire by external airflows.

To achieve the above objective, the present invention provides a structure that comprises a heater body, a pilot fire assembly, and a switch unit, wherein the heater body comprises a burner, which is connected to a gas supply tube, and a valve switch, which is adapted to connect to a fuel gas supply source, the valve switch being provided on a top side thereof with a fuel gas valve rod, which functions to control the valve switch to supply or not supply fuel gas to the burner; the pilot fire assembly is mounted to the heater body at a location adjacent to the burner, the pilot fire assembly comprising a pilot fire tube, an ignition pin, and a thermocouple, the pilot fire assembly being covered and housed by a protective cover, the protective cover being formed with a plurality of ventilation holes, a guiding space being formed between one side of the protective cover and the heater body; and the switch unit is mounted by a mounting frame to the valve switch, the mounting frame comprising an ignition switch connected to an ignition circuit of the ignition pin, a shut-down switch connected to a circuit of the thermocouple, an ignition operator, and a shut-down operator, wherein the ignition operator and the shut-down operator each have an end movably mounted to the mounting frame to form a swingable arrangement; the ignition switch and the fuel gas valve rod are arranged below the ignition operator to be contactable and pressable down by the ignition operator; and the shut-down switch is arranged below the shut-down operator to be contactable and pressable down by the shut-down operator.

A user may operate the ignition operator to contact and press the fuel gas valve rod and the ignition switch, so as to open the valve switch to supply fuel gas to the burner and also activate the ignition circuit to cause successive shootings of the ignition pin of the pilot fire assembly to ignite and set a fire on the burner. The user may operate the shut-down operator to contact and press the shut-down switch, so as to cut off a signal of the thermocouple and thus cut off the supply of fuel gas to the heater structure of this invention. Optionally, the ignition operator and the shut-down operator are structured to collectively form a seesaw structure, which prevents two ends thereof from being activated and operated at the same time so as to achieve a foolproof function.

The protective cover guides a pilot fire generated by the pilot fire assembly toward the burner, and allows air to be introduced from the front side to support flaming of the pilot fire and reduce undesired influence imposed on the pilot fire by external airflows.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
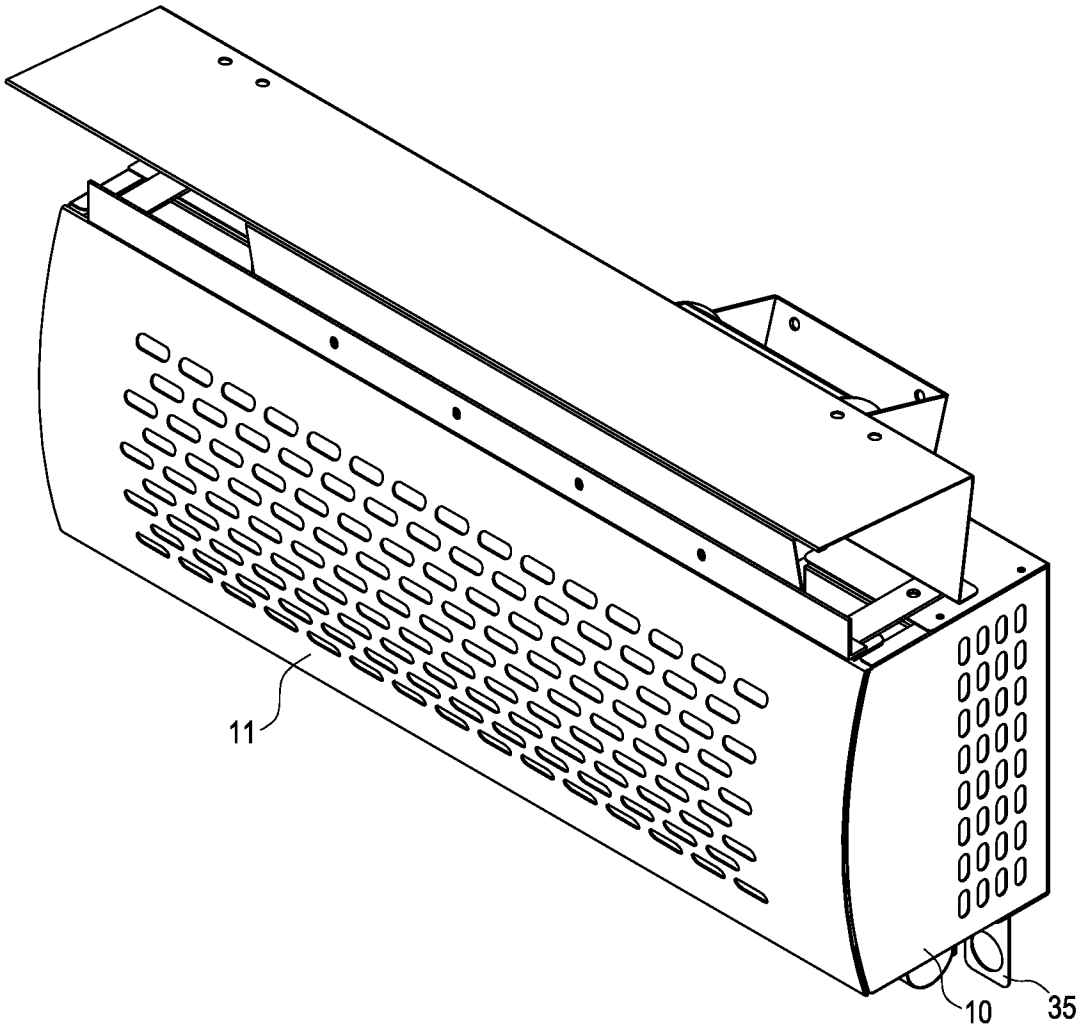
FIG. 1 is a perspective view of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-5, an embodiment of the present invention is related to an outdoor heating device, which comprises a heater body 10, a pilot fire assembly 20, and a switch unit 30. Details will be provided below.

The heater body 10 comprises a burner 40, wherein the burner 40 is connected to and in communication with a gas supply tube 41, and a valve switch 42, wherein the valve switch 42 is connected to a fuel gas supply source. The valve switch 42 is provided on a top side thereof with a fuel gas valve rod 43. The fuel gas valve rod 43 functions to control the valve switch 42 to supply or not supply fuel gas (such as combustive gas) to the burner 40.

The pilot fire assembly 20 is mounted to the heater body 10 at a location adjacent to the burner 40. The pilot fire assembly 20 comprises a pilot fire tube 21, an ignition pin 22, and a thermocouple 23. The pilot fire assembly 20 is covered and housed by a protective cover 50. The protective cover 50 is formed with a plurality of ventilation holes 51. A guiding space is formed between one side of the protective cover 50 and the heater body 10.

The switch unit 30 is mounted by a mounting frame 31 to the valve switch 42. The mounting frame 31 comprises an ignition switch 32 connected to an ignition circuit of the ignition pin 22, a shut-down switch 33 connected to a circuit of the thermocouple, an ignition operator 34, and a shut-down operator 35. The ignition operator 34 and the shut-down operator 35 each have an end movably mounted to the mounting frame 31 to provide a rotationally movable or swingable arrangement. The ignition switch 32 and the fuel gas valve rod 43 are arranged below the ignition operator 34 to be contactable and thus pressed down by the ignition operator 34. The shut-down switch 33 is arranged below the shut-down operator 35 to be contactable and thus pressed down by the shut-down operator 35.

In the instant embodiment, the heater body 10 is provided, on a front side thereof, with a surface panel 11, which provides protection to the pilot fire assembly 20 and the burner 40 and also provides an effect of beautification.

In one embodiment, a flow guide board 12 is arranged at a lower side of the front of the heater body 10 to guide airflows at the front side of the burner 40 to move upwards so that a flame of the burner 40 is protected from being cause to float around and even blow out in order to improve wind resistance of the heater.

In one embodiment, the plurality of ventilation holes 51 of the protective cover 50 are located on a surface portion of the protective cover 50 that is located frontward of the pilot fire assembly 20, to serve as air supply holes for introducing air from the front side for combustion of the pilot fire.

In one embodiment, the ignition switch 32 and the shut-down switch 33 are each a microswitch.

In one embodiment, a round bar 60 is arranged between an upper side of the fuel gas valve rod 43 and an underside of the ignition operator 34 and the mounting frame 31 is formed with two guard slots 36 that are opposite to and corresponding to each other. Two ends of the round bar 60 are respectively received in and guided by the guard slots 36 to provide a movable arrangement. The ignition operator 34, upon rotationally moving or swinging downward, presses down the round bar 60 to press the fuel gas valve rod 43.

The round bar 60 provides an effect of reducing friction and saving effort for the site of the fuel gas valve rod 43 where a force is applied so as to make the operation and structure of the switch unit 30 smoother.

In one embodiment, the ignition operator 34 and the shut-down operator 35 are mounted to the mounting frame 31 in a movable manner through pivoting and are each structured as an inverted L-shaped board.

The ignition operator 34 and the shut-down operator 35 are formed with an openings 341, 351, respectively, to allow a user's finger to insert into the openings 341, 351 to pull the ignition operator 34 and the shut-down operator 35 downward.

The above provides a description to the components/parts of this invention. A description concerning the operation and features of this invention will be provided below.

A user may operate the ignition operator 34 to contact and press the fuel gas valve rod 43 and the ignition switch 32, so as to open the valve switch 42 to supply fuel gas to the burner 40 and also activate the ignition circuit to cause successive shootings of the ignition pin 22 of the pilot fire assembly 20 to ignite and set a fire on the burner 40. The user may operate the shut-down operator 35 to contact and press the shut-down switch 33, so as to cut off a signal of the thermocouple 23 and thus cut off the supply of fuel gas to the heater structure of this invention.

As such, the user may easily operate the switches of the heater. Compared to the known outdoor heating device, of which the flame is often blown out by winds or gusts when located outdoors, so that re-ignition must be often carried out with the ignition switch, this invention provides a structure having excellent functionality and ensuring convenience of operating heater switches.

Figure 2:
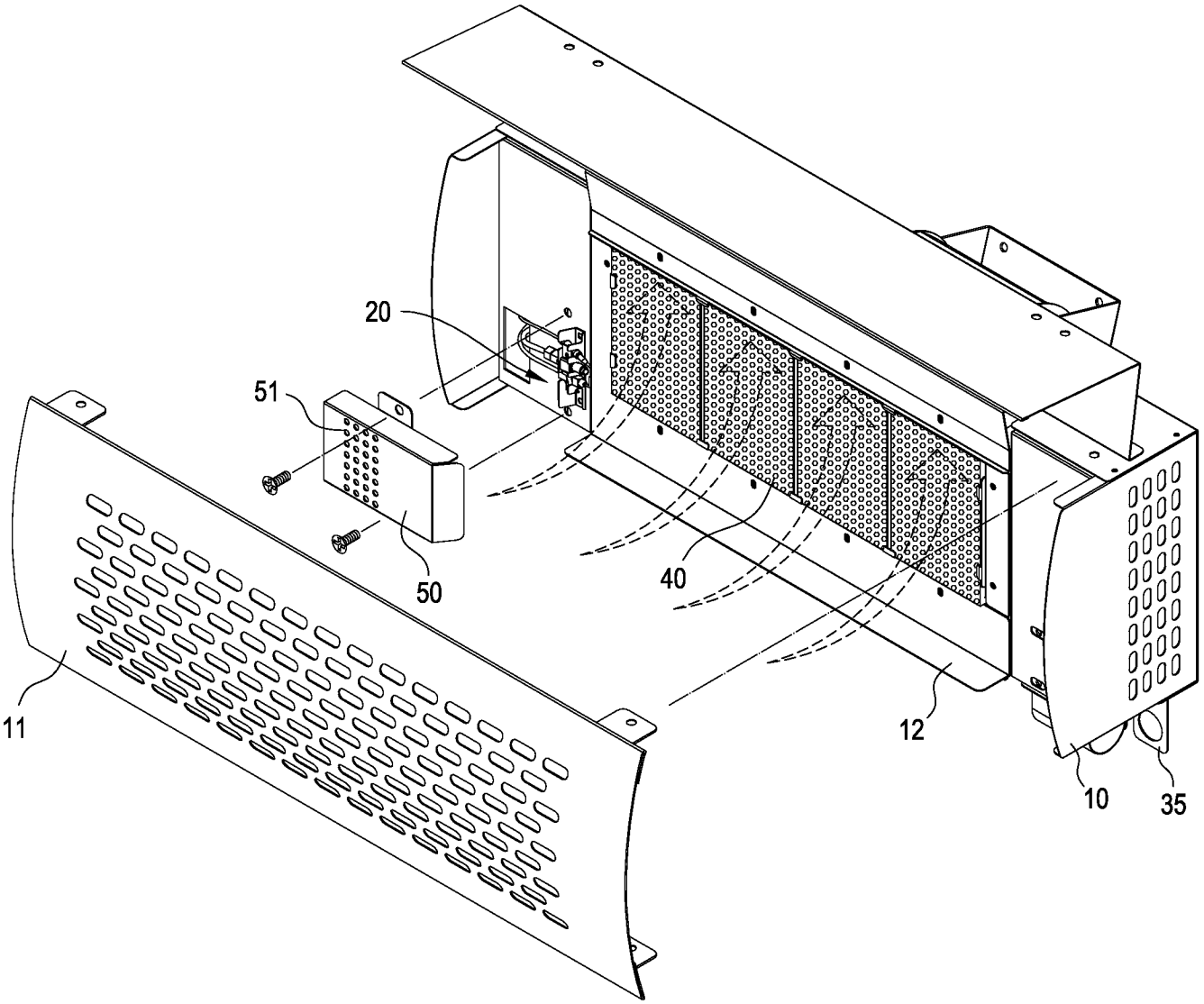
FIG. 2 is a schematic view showing the present invention in condition where a surface panel and a protective cover are removed and airflows being guided by a flow guide board.
Figure 3:
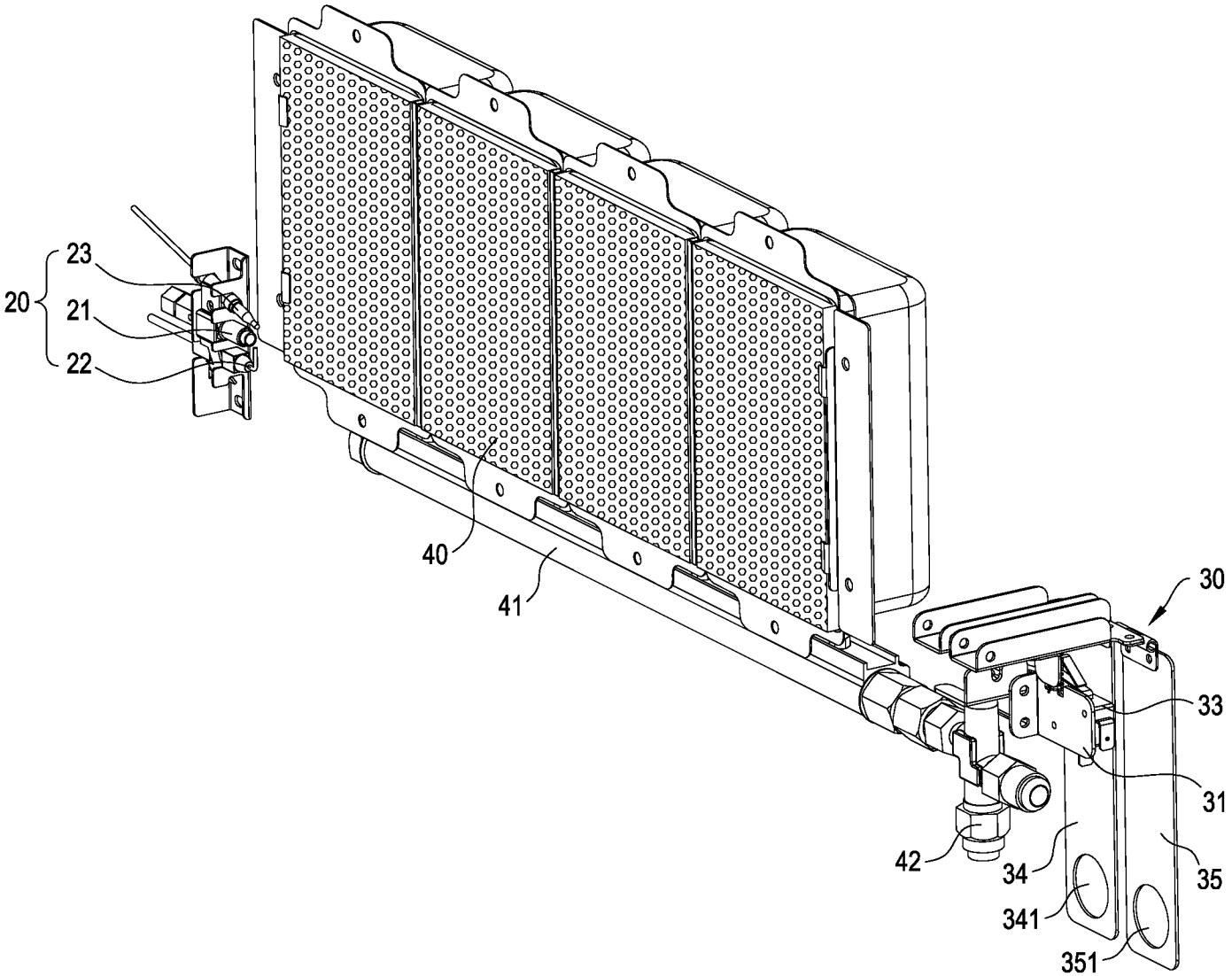
FIG. 3 is a perspective view showing a burner, a pilot fire assembly, and a switch unit of the present invention.
Figure 4:
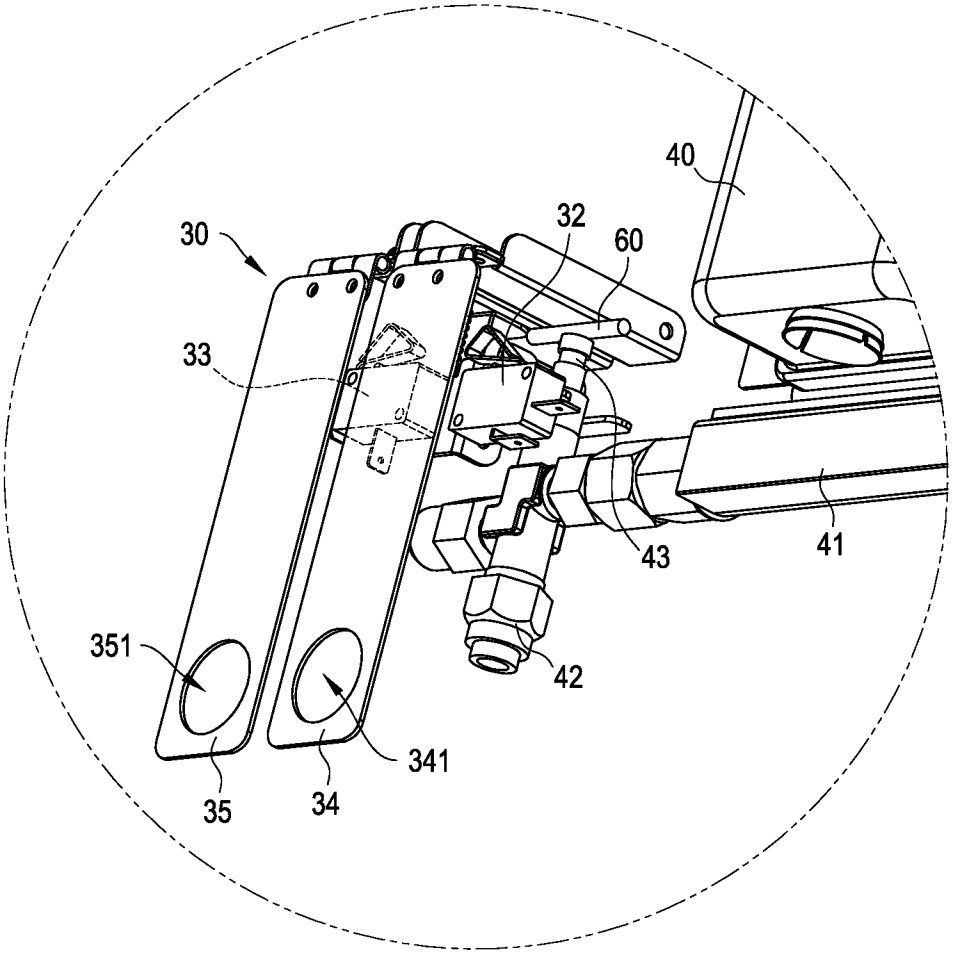
FIG. 4 is a perspective view showing the switch unit from a different angle and in an enlarged form.
Figure 5:
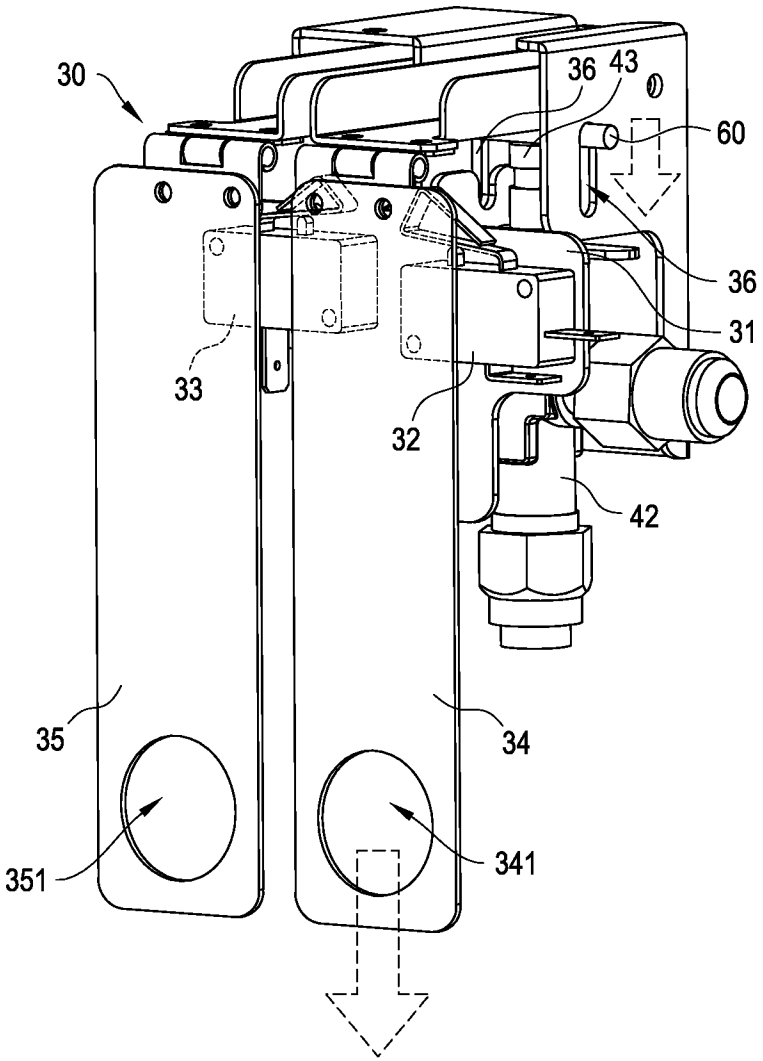
FIG. 5 is a schematic view illustrating the switch unit of the present invention mounted to a mounting frame.

Referring to FIG. 2, the protective cover 50 guides a pilot fire generated by the pilot fire assembly 20 toward the burner 40, and allows air to be introduced from the front side to support flaming of the pilot fire and reduce undesired influence imposed on the pilot fire by external airflows.

Figure 6:
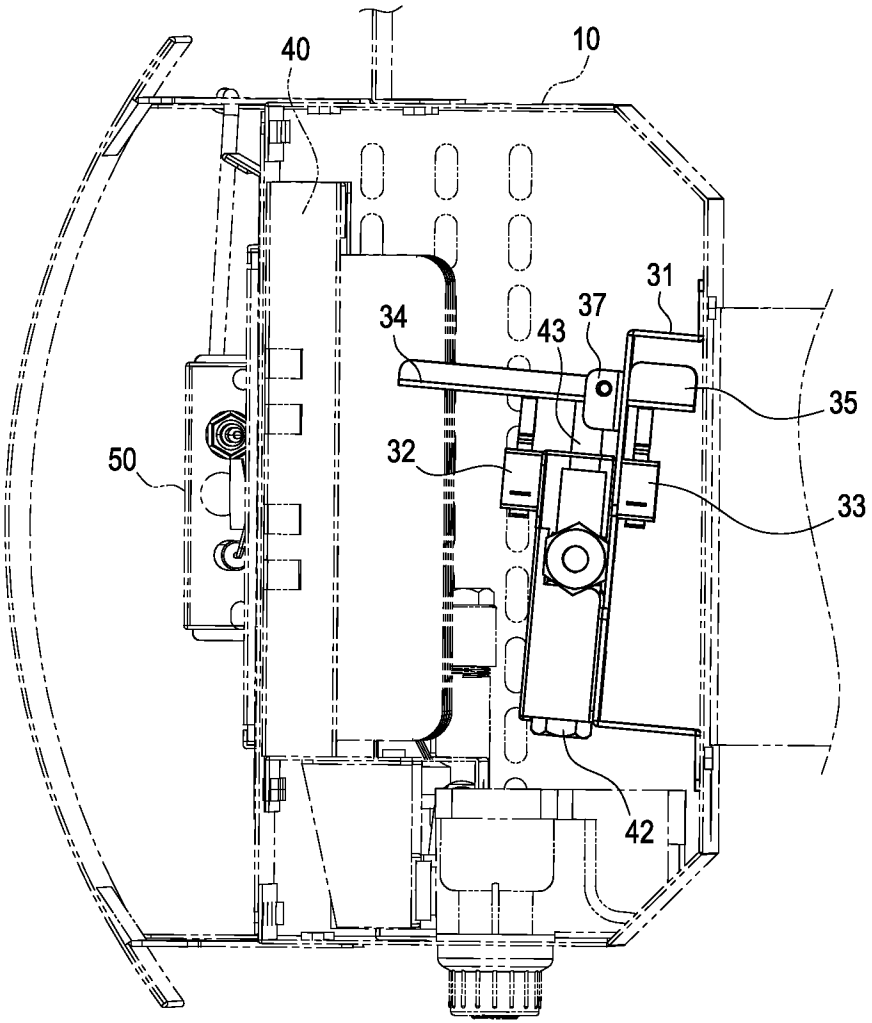
FIG. 6 is a schematic view showing another structure of the present invention.

Referring to FIG. 6, the present invention also provides another structure, in which the ignition operator 34 and the shut-down operator 35 have ends that are connected to each other and the connected ends are movably pivoted to a support point or fulcrum 37 provided on the mounting frame 31, so that the ignition operator 34 and the shut-down operator 35 collectively form an see-saw arrangement, which prevents the ignition operator 34 and the shut-down operator 35 from being activated and operated at the same time and thus providing a foolproof function.

Figure 7:
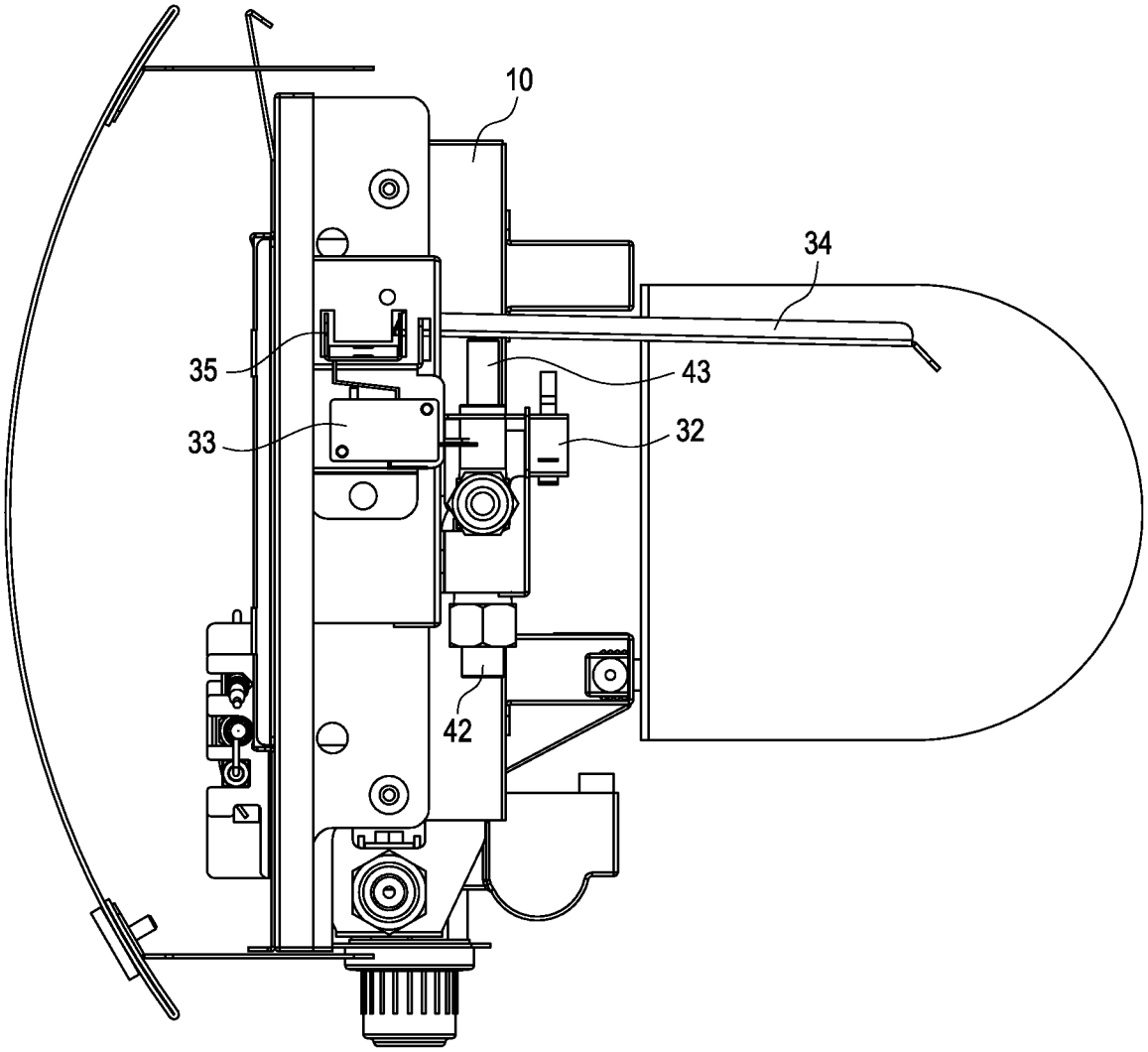
FIG. 7 is a schematic view showing a further structure of the present invention.

Referring to FIG. 7, the ignition operator 34 and the shut-down operator 35 are arranged to form a 90-degree angle therebetween to allow for easy operation of the switches of the heater by the user.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A heater structure, comprising:

a heater body, which comprises a burner, which is connected to a gas supply tube, and a valve switch, which is adapted to connect to a fuel gas supply source, the valve switch being provided on a top side thereof with a fuel gas valve rod, which functions to control the valve switch to supply or not supply fuel gas to the burner;

a pilot fire assembly, which is mounted to the heater body at a location adjacent to the burner, the pilot fire assembly comprising a pilot fire tube, an ignition pin, and a thermocouple, the pilot fire assembly being covered and housed by a protective cover, the protective cover being formed with a plurality of ventilation holes, a guiding space being formed between one side of the protective cover and the heater body; and a switch unit, which is mounted by a mounting frame to the valve switch, the mounting frame comprising an ignition switch connected to an ignition circuit of the ignition pin, a shut-down switch connected to a circuit of the thermocouple, an ignition operator, and a shut-down operator, wherein the ignition operator and the shut-down operator each have an end movably mounted to the mounting frame to form a swingable arrangement; the ignition switch and the fuel gas valve rod are arranged below the ignition operator to be contactable and pressable down by the ignition operator; and the shut-down switch is arranged below the shut-down operator to be contactable and pressable down by the shut-down operator.

2. The heater structure according to claim 1, wherein a flow guide board is arranged at a lower side of a front of the heater body to guide airflows at a front side of the burner to move upwards.

3. The heater structure according to claim 1, wherein the plurality of ventilation holes of the protective cover are located on a surface portion of the protective cover that is located frontward of the pilot fire assembly to serve as air supply holes.

4. The heater structure according to claim 1, wherein the ignition switch and the shut-down switch each comprise a microswitch.

5. The heater structure according to claim 1, wherein a round bar is arranged between an upper side of the fuel gas valve rod and an underside of the ignition operator and the mounting frame is formed with two guard slots that are opposite to and corresponding to each other, two ends of the round bar being received in the guard slots in a movable manner, wherein the ignition operator, upon swinging downward, presses down the round bar to press the fuel gas valve rod.

6. The heater structure according to claim 1, wherein the ignition operator and the shut-down operator are mounted to the mounting frame in a movable manner through pivoting and are each structured as an inverted L-shaped board.

7. The heater structure according to claim 6, wherein the ignition operator and the shut-down operator are formed with openings for an operation of pulling the ignition operator and the shut-down operator downward.

8. The heater structure according to claim 1, wherein ends of the ignition operator and the shut-down operator have ends connected to each other and are pivotally coupled to a fulcrum formed on the mounting frame so that the ignition operator and the shut-down operator collectively form an see-saw arrangement.

9. The heater structure according to claim 1, wherein the ignition operator and the shut-down operator are arranged to form a 90-degree angle therebetween.

* * * * *